United States Patent [19]

Clarkson

[11] 4,351,134

[45] Sep. 28, 1982

[54] HINGED GUTTER GUARD

[76] Inventor: James A. Clarkson, 257 Jeffery La., Northfield, Ill. 60093

[21] Appl. No.: 240,376

[22] Filed: Mar. 4, 1981

[51] Int. Cl.[3] ..... E04D 13/00

[52] U.S. Cl. ..... 52/12; 210/474

[58] Field of Search ..... 210/474, 473, 475, 455; 248/48.1; 52/12, 15, 16; 405/120, 121, 122, 123; 16/129–134; 220/331; 55/493

[56] References Cited

U.S. PATENT DOCUMENTS

| | | | |
|---|---|---|---|
| 1,624,517 | 4/1927 | Stamp | 220/331 |
| 2,072,415 | 3/1937 | Abbitt | 210/474 |
| 2,271,081 | 1/1942 | Layton | 52/15 |
| 2,841,100 | 7/1958 | Moller | 210/474 |
| 3,047,994 | 8/1962 | Brun | 55/493 |
| 3,053,393 | 9/1962 | McLean | 210/474 |
| 3,420,378 | 1/1969 | Turner | 20/474 |
| 4,032,456 | 6/1977 | Berce | 210/474 |

*Primary Examiner*—Benoit Castel

*Attorney, Agent, or Firm*—Tilton, Fallon, Lungmus

[57] ABSTRACT

A hinged gutter guard in the form of an elongated perforated cover plate made of relatively rigid sheet material and equipped along one longitudinal edge with a plurality of hinge straps adapted to be secured to a roof beneath the lower course of shingles thereof. The hinge straps, although permanently attached to the cover plate, are capable of being shifted along the plate to a limited extent to insure proper attachment and operation of the guard.

8 Claims, 3 Drawing Figures

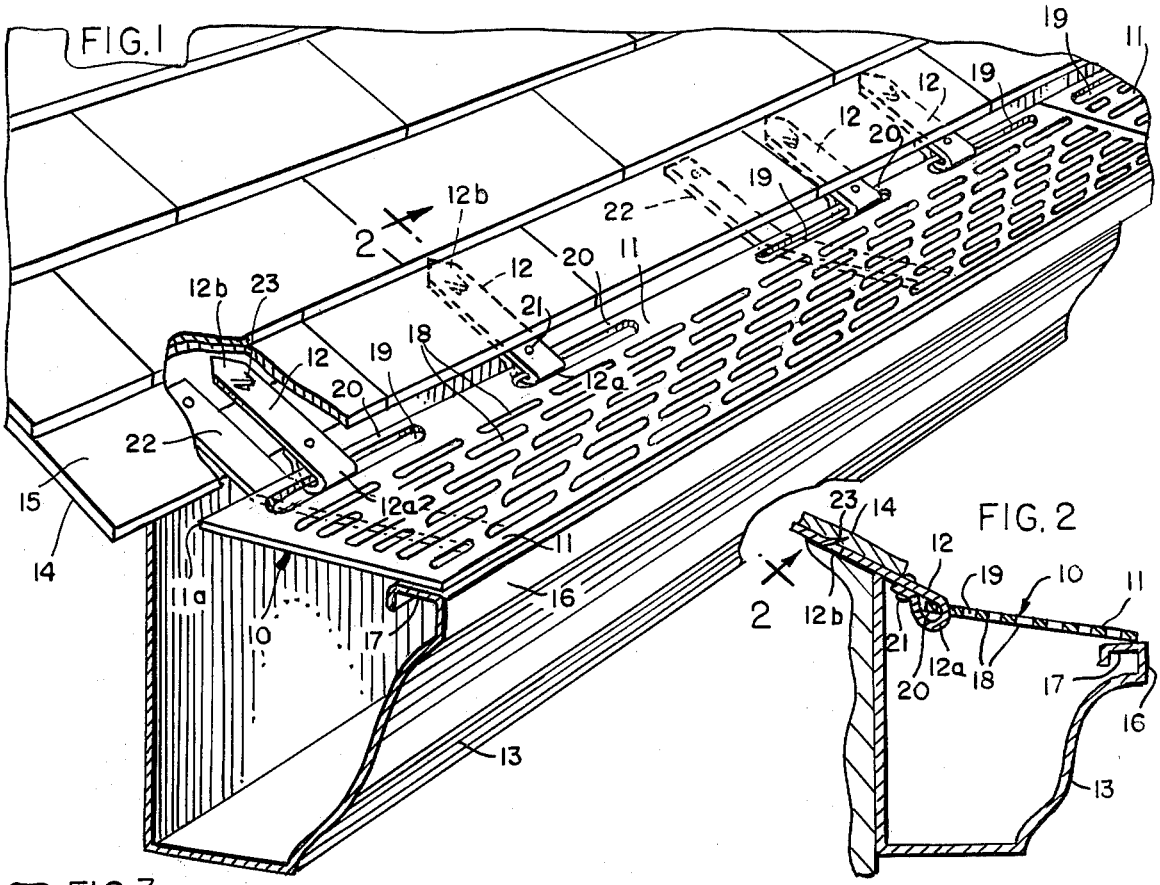
FIG. 1
19
11
12
19
12
20
12b
2
22
19
12
20
11
12b
23
21
12
19
18
12a
20
22
15
12a
2
14
11
11a
10
17
16
13
FIG. 2
23
14
12
19
10
11
2
12b
21
12a
18
20
17
16
13
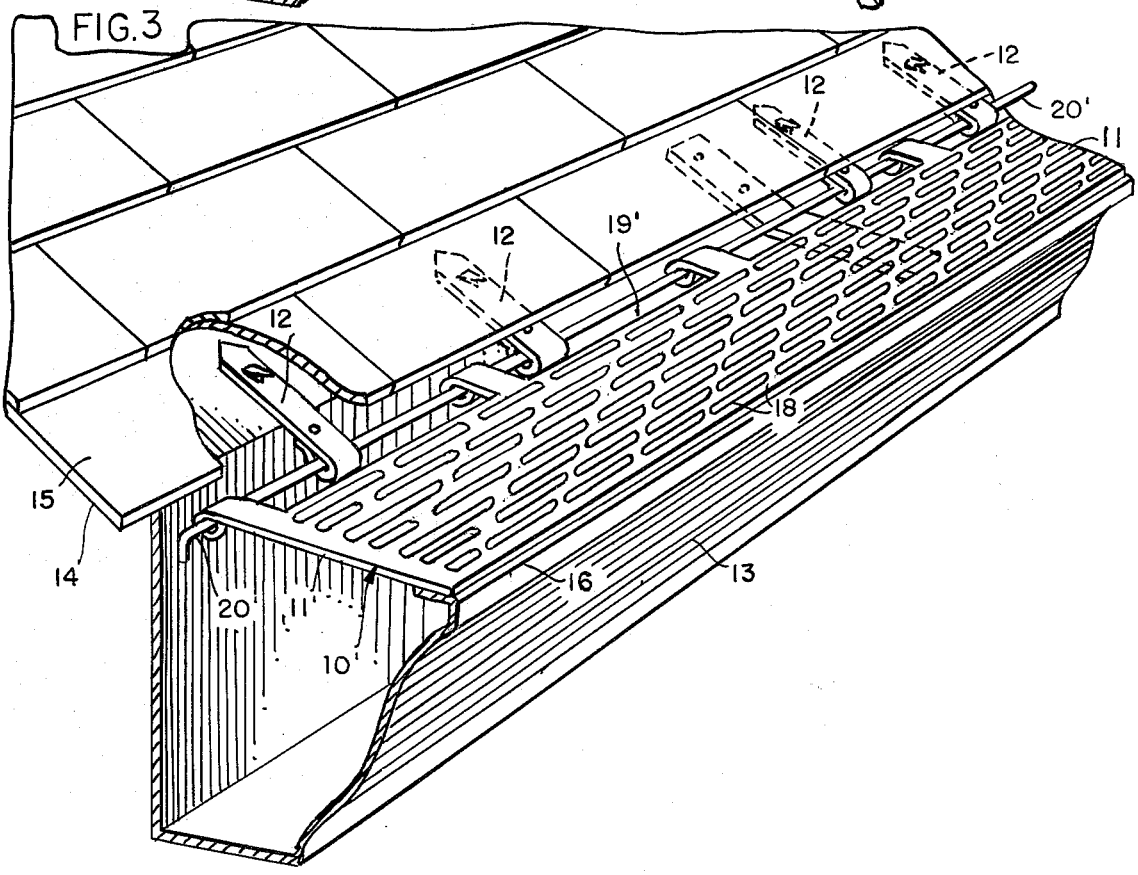
FIG. 3
12
12
20'
11
12
19'
12
18
15
14
16
13
20'
11'
10'

HINGED GUTTER GUARD

BACKGROUND AND SUMMARY

Gutter guards formed of wire mesh are presently available commercially for installation along the gutters of houses and other buildings for the purpose of blocking the entry of leaves and other debris while at the same time allowing rain water to drain into the gutters. Installation is complicated by the fact that such a wire mesh guard is commonly marketed in rolled form and must therefore be unrolled or flattened prior to attachment. Because of its wire mesh construction, such a guard is readily deformed, increasing difficulties of installation and, at least in some instances, reducing the effectiveness of the guard following installation. The usefulness of such a product is further diminished by the difficulty of temporarily removing the guard when it becomes necessary to remove debris that manages to enter the gutter despite the presence of the mesh guard strip.

Efforts have been made to alleviate the latter problem by hinging the wire mesh guard upon a gutter, or upon the roof adjacent the gutter, so that the hinged mesh strip may be more readily lifted and lowered whenever cleaning of a gutter is required. Typical constructions are disclosed in U.S. Pat. Nos. 3,834,091, 3,977,135, 2,469,841, 2,841,100, 2,542,155, 3,420,378, and 4,032,456. While the hinged mounting of such mesh or screen cover strips does facilitate gutter cleaning, it tends to further increase the difficulty of installation, particularly on gutters of the type now commonly in use wherein bridging straps extend over such a gutter at intervals of 18 to 36 inches for bracing and supporting the gutter along the edge of the roof. Furthermore, in operation such mesh gutter guards may be less than satisfactory because deformation of the wire mesh material may interfere with pivotal movement of the guards between their raised and lowered positions.

Accordingly, it is a main object of this invention to provide a hinged gutter guard that is relatively easy to adjust and install regardless of the number and location of mounting straps securing a gutter along the edge of a roof. Specifically, it is an object to provide a gutter guard equipped with preassembled hinges that may be easily positioned by a user for attachment to a roof, and preferably to the undersides of the lower course of shingles along that roof, without interference from the existing mounting straps or brackets supporting the gutter along that roof. The guard, which takes the form of a relatively rigid perforated plate, may be used to help direct and position the hinge straps for attachment to the roof either before or after such straps have been shifted longitudinally along the guard into selected noninterfering positions of adjustment. Once properly located, the hinge straps are simply fixed in place by barbs which project from the tongues of the straps and which engage the undersides of the shingles along the roof's lower edge.

Since the perforated cover plate is formed from relatively rigid sheet material, and ideally from a material capable of recovering its planar condition following the removal of distorting forces, ease of installation is further enhanced and the possibilities of deformation adversely affecting subsequent operation of the guard are reduced.

In a preferred embodiment of the invention, the perforated rectangular plate is provided with a plurality of elongated slots extending in longitudinal series along one edge thereof to define a series of hinge bars formed integrally with the plate. At least one hinge strap extends through each of the slots, and is provided with a closed loop portion receiving a hinge bar, for pivotally securing the gutter guard to a roof. Since the width of each hinge strap is substantially less than the length of the slot to which it extends, each hinge strap may be readily shifted into the most suitable position of adjustment for attachment to a roof.

Other features, advantages, and objects of the invention will become apparent from the specification and drawings.

DRAWINGS

FIG. 1 is a perspective view of a hinged gutter guard embodying the present invention, such guard being shown mounted upon a roof over a conventional gutter.

FIG. 2 is a vertical sectional view taken along line 2—2 of FIG. 1.

FIG. 3 is a perspective view similar to FIG. 1 but illustrating a second embodiment of the invention.

DETAILED DESCRIPTION

Referring to FIGS. 1 and 2 of the drawings, numeral 10 generally designates a hinged gutter guard embodying the invention and consisting essentially of a perforated rectangular plate 11 and a plurality of hinge straps 12. When properly mounted as shown, the gutter guard extends over the open top of a gutter 13 and is connected by the hinge straps 12 to the roof 14 of a building beneath the shingles at the lower edge of that roof.

The cover plate or sheet 11 is dimensioned to extend over, but not beyond, the front lip 16 of the gutter, resting upon the inwardly-turned flange 17 of that lip. While dimensions may be varied depending on the size of the gutter, it has been found that for use with a standard residential gutter the cover plate should have a width within the range of approximately 4 to 5 inches, preferably 4.25 to 4.75 inches, and a length of about 30 to 60 inches, preferably about 36–48 inches. A series of such plates are mounted along the edge of the roof for the full length of the gutter, such plates being arranged in end-to-end alignment as indicated in FIG. 1. Overlapping of the ends of adjacent plates is permissible and is particularly useful where the length of the gutter is not a precise multiple of the combined lengths of cover plates 11. If desired, instead of overlapping adjacent cover plates, or in addition to overlapping such plates, a user may cut one or more of the plates to reduce the length thereof and thereby match their combined length to that of the gutter.

Cover plates 11 are formed of relatively rigid sheet material such as, for example, galvanized steel. Other metals having similar properties might be used and other materials, particularly rigid (but not brittle) polymeric sheet materials may be effectively employed. In any event, the sheet material should have limited flexibility and be capable of recovering its original planar configuration when the distorting forces causing such limited deformation are removed. Because each cover plate 11 is a unitary structure formed of sheet material, in contrast to wire mesh screen in which the strands are capable of individual movement, elongation, and deformation in response to distorting forces, gutter guard 10 is relatively easy to align with a gutter, and with other gutter guard assemblies, during installation, and is capable of resisting (or recovering from) distorting forces in use that might otherwise reduce the effectiveness of the guard and render it difficult or impossible to pivot between its lowered and raised positions when gutter cleaning becomes necessary. Furthermore, the planar character of perforated plate 11 is believed less likely to snag or entrap twigs and leaves, in contrast to the undulating surface of a wire mesh screen.

A multiplicity of perforations or openings 18 extend through cover plate 11 to permit rain water to pass through the plate while at the same time blocking the passage of leaves, twigs, or other debris. In the illustration given, the perforations are oblong and staggered and it is believed that such a shape and relationship are particularly effective for purposes of this invention. However, it is to be understood that perforations of other shapes, sizes, and arrangements might be utilized.

A series of longitudinally-spaced slots 19 extend along the rear longitudinal edge 11*a* of the cover plate 11 and are spaced from that edge to define a series of hinge bars 20 formed as integral portions of the plate. As shown in FIG. 1, each slot 19 is longitudinally elongated; hence, the hinge bar 20 extending alongside that slot is also longitudinally elongated. At least one hinge strap 12 extends through each slot, the strap having a looped or reversely-turned portion 12*a* which extends through the slot and about the hinge bar 20 to provide a pivotal interconnection between the hinge strap and cover plate. The loop is a closed one; that is, a rivet 21 or other suitable connecting means permanently joins the end of the looped portion 12*a* to the planar tongue portion 12*b* of the hinge strap 12. The permanent interconnection facilitates installation of the gutter guards by a user, since the straps and plates are preassembled and since alignment of a cover plate 11 upon a gutter 13 also causes the hinge straps, with their tongue portions 12*a* inserted beneath the lower course of shingles 15, to assume positions approximating their final locations. In addition, the permanent interconnection between the hinge straps and cover plate insures inadvertent or unwanted detachment of the parts will not occur either during installation or during subsequent use and operation of the gutter guard.

It will be noted that the length of each slot 19 is substantially greater than the width of the hinge strap extending therethrough. Consequently, each hinge strap may be moved longitudinally a substantially distance along the length of cover plate 11. Such movement permits adjustment of each strap into the most suitable position for any given installation and, in particular, permits each hinge strap to be positioned away from the support straps 22 that support the gutter and that lie directly beneath cover plate 11 when that plate is in its lowered position (FIG. 1). Although the relationship between the length of each slot 19 and the width of hinge strap 12 may be varied considerably, it is believed important that the length/width ratio should be at least 2:1, and preferably more than 3:1.

The planar tongue portion 12*b* of each hinge strap 12 is provided with a barb 23 which angles upwardly and towards cover plate 11 to engage the underside of a shingle 15 and to lock the tongue against downward and outward movement once the gutter guard assembly has been adjusted into its final operation position. While barb 23 is believed to be a particularly effective means for securing each hinge strap 12 in place, other attachment means including adhesives might also be used.

During installation of a gutter guard, a user first inserts the tongue portions of the hinge straps beneath the lower course of shingles with the straps in approximately their final positions along slots 19. Such insertion is facilitated if cover plate 11 is first folded back so that it overlies, or is generally parallel with, the shingles and hinge straps, since the reversely-folded plate may then be easily gripped to force the hinge straps beneath the shingles. Final repositioning of the straps along the slots 19 may be undertaken when the lowered cover plate 11 overlies the gutter and has its free longitudinal edge aligned with lip 16. Ordinarily, such positioning of the hinge straps will permit limited longitudinal movement of a cover plate 11 even after a gutter guard is fully installed, and such intentional longitudinal movement would be desirable for purposes of adjusting one plate in relation to an adjacent plate. Where overlapping of the ends of adjacent plates is provided, such longitudinal adjustability may permit a user to shift adjacent plates out of such overlapping relationship when lifting of one of the plates is desired for purposes of gaining access to the portion of the gutter covered by that plate. On the other hand, if a user prefers not to mount the cover plates for limited longitudinal adjustability, he may simply position two hinge straps 12 at opposite ends of their respective slots so that when such straps are secured to the roof the pivotally-mounted cover plate 11 will be locked against longitudinal displacement or movement.

The embodiment depicted in FIG. 3 is similar to the construction already described except that hinge bar 20' takes the form of a rod secured to cover plate 11' rather than being an integral portion of the cover plate. Straps 12 extend through slots 19' in the same manner already described, and the installation and operation of the two assemblies are essentially the same.

While in the foregoing I have disclosed embodiments of the invention in considerable detail for purposes of illustration, it will be understood by those skilled in the art that many of these details may be varied without departing from the spirit and scope of the invention.

I claim:

1. In combination with the sloping roof of a building having a generally horizontal open-topped gutter extending alongside a lower edge thereof, a gutter guard comprising a rigid perforated rectangular cover plate extending over a longitudinal segment of said gutter, said cover plate having a plurality of elongated slots arranged in serial alignment along one of the longitudinal edges thereof, hinge bar means extending along each of said slots, and a plurality of hinge straps each having a closed loop portion extending through one of said slots and about said hinge bar means, and having a tongue portion fixed to the lower portion of said roof, for pivotally supporting said cover plate over said gutter, the loop portion of each of said straps having a width substantially less than the length of the slot through which said loop portion extends.

2. The combination of claim 1 in which said loop portions of said straps extend through intermediate portions of said slots to permit limited longitudinal displacement of said cover plate relative to said gutter.

3. The combination of claim 1 in which at least two of said hinge straps are located at opposite ends of their respective slots to lock said cover plate against longitudinal displacement relative to said gutter.

4. The combination of claims 1, 2, or 3 in which a plurality of said gutter guards are mounted upon said roof with the perforated cover plates thereof disposed in longitudinal alignment.

5. The combination of claim 4 in which end portions of at least a pair of adjacent cover plates are disposed in overlapping relation.

6. The combination of claim 1 in which said rectangular perforated cover plate has a width of about 4 to 5 inches and a length within the range of about 30 to 60 inches.

7. The combination of claim 1 in which said hinge bar means comprises a plurality of aligned hinge bars formed integrally with said cover plate.

8. The combination of claim 1 in which said hinge bar means comprises a hinge rod secured to said cover plate.

* * * * *